US009766578B2

(12) United States Patent
Narahara et al.

(10) Patent No.: US 9,766,578 B2
(45) Date of Patent: Sep. 19, 2017

(54) FIXING DEVICE

(71) Applicant: CANON KABUSHIKI KAISHA, Tokyo (JP)

(72) Inventors: Takashi Narahara, Mishima (JP); Toru Imaizumi, Kawasaki (JP); Yasuhito Minamishima, Odawara (JP); Kenichi Ogawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/932,615

(22) Filed: Nov. 4, 2015

(65) Prior Publication Data

US 2016/0132006 A1 May 12, 2016

(30) Foreign Application Priority Data

Nov. 6, 2014 (JP) ..... 2014-226484

(51) Int. Cl.
*G03G 15/20* (2006.01)

(52) U.S. Cl.
CPC ..... *G03G 15/2053* (2013.01)

(58) Field of Classification Search
CPC ..... G03G 15/2014; G03G 15/2053; G03G 15/2046
USPC ..... 399/329
See application file for complete search history.

(56) References Cited

U.S. PATENT DOCUMENTS

| | | | | |
|---|---|---|---|---|
| 8,712,268 | B2 * | 4/2014 | Iwasaki | G03G 15/2053 399/328 |
| 2006/0045589 | A1 * | 3/2006 | Iwasaki | G03G 15/2042 399/328 |
| 2008/0292376 | A1 * | 11/2008 | Nishiyama | G03G 15/2042 399/330 |
| 2014/0186078 | A1 * | 7/2014 | Imaizumi | G03G 15/2017 399/329 |

FOREIGN PATENT DOCUMENTS

| | | | |
|---|---|---|---|
| JP | 10125450 | A | 5/1998 |
| JP | 11084919 | A | 3/1999 |
| JP | 2003280442 | A | 10/2003 |
| JP | 2003282219 | A | 10/2003 |
| JP | 2006092916 | A | 4/2006 |

* cited by examiner

*Primary Examiner* — Walter L Lindsay, Jr.
*Assistant Examiner* — Philip Marcus T Fadul
(74) *Attorney, Agent, or Firm* — Canon U.S.A. Inc., IP Division

(57) ABSTRACT

A fixing device includes a tubular film; a heater including a first surface being in contact with the film, the heater including a substrate and a heat-generating resistor; a heat-conductive member being in contact with a second surface of the heater opposite to the first surface, the heat-conductive member having a higher thermal conductivity than the substrate; and a supporting member supporting the heater with the heat-conductive member interposed therebetween. The heat-conductive member includes first and second parts at upstream and downstream ends, respectively, in a conveyance direction, and a third part between the first and second parts. The first to third parts are each held between (Continued)

the supporting member and the heater. A non-contact area between the heat-conductive member and the supporting member is provided between the first part and the second part in the conveyance direction. The heat-conductive member is shorter than the heater in the conveyance direction.

6 Claims, 11 Drawing Sheets

FIXING DEVICE

BACKGROUND OF THE INVENTION

Field of the Invention

The present invention relates to a fixing device included in an image forming apparatus, such as a copier or a laser-beam printer, employing an electrophotographic image forming process.

Description of the Related Art

Some known fixing devices included in electrophotographic image forming apparatuses employ films. Such a fixing device includes a tubular film and a heater provided in contact with the inner surface of the film, and fixes a toner image on a recording material by utilizing the heat of the film.

The film employed by the fixing device has a small heat capacity. Therefore it is known that, if recording materials of small sizes are successively subjected to the fixing process, the temperature in a non-sheet-passing area where the recoding materials do not pass tends to rise excessively. Hence, in a fixing device disclosed by Japanese Patent Laid-Open No. 11-84919, a metal plate is provided between a heater and a supporting member so that the heat in a non-sheet-passing area is diffused by the metal plate, whereby the excessive rise of the temperature in the non-sheet-passing area is suppressed.

The fixing device disclosed by Japanese Patent Laid-Open No. 11-84919, however, has a problem in that the heat of the heater tends to be transferred to the supporting member through the metal plate and, consequently, the warm-up time of the fixing device increases. Accordingly, the present invention provides a fixing device in which the excessive rise of the temperature in the non-sheet-passing area is suppressed while a short warm-up time is realized.

SUMMARY OF THE INVENTION

According to an aspect of the present invention, there is provided a fixing device that fixes a toner image on a recording material while conveying the recording material carrying the toner image at a nip. The fixing device includes a tubular film; a heater including a first surface that is in contact with the film, the heater including a substrate and a heat-generating resistor provided on the substrate; a heat-conductive member that is in contact with a second surface of the heater opposite to the first surface, the heat-conductive member having a higher thermal conductivity than the substrate; and a supporting member that supports the heater with the heat-conductive member interposed between the supporting member and the heater. The heat-conductive member includes a first part disposed at an upstream end in a conveyance direction of the recording material, the first part being in contact with both the supporting member and the heater and being held between the supporting member and the heater; a second part disposed at a downstream end in the conveyance direction, the second part being in contact with both the supporting member and the heater and being held between the supporting member and the heater; and a third part disposed between the first part and the second part in the conveyance direction, the third part being in contact with both the supporting member and the heater and being held between the supporting member and the heater. A non-contact area, in which the heat-conductive member is not in contact with the supporting member, is provided between the first part and the second part in the conveyance direction. A length of the heat-conductive member in the conveyance direction is shorter than a length of the heater in the conveyance direction.

Further features of the present invention will become apparent from the following description of exemplary embodiments with reference to the attached drawings.

DESCRIPTION OF THE EMBODIMENTS

Embodiments of the present invention will now be described with reference to the accompanying drawings. The following description begins with an outline of a fixing device according to an embodiment of the present invention, followed by features of the embodiment.

First Embodiment

In the following description, the term "long-side direction" refers to a direction orthogonal to a direction of conveyance of a recording material in a plane in which each recording material is conveyed, and the term "short-side direction" refers to the direction of conveyance of the recording material.

Fixing Device

Figure 1:
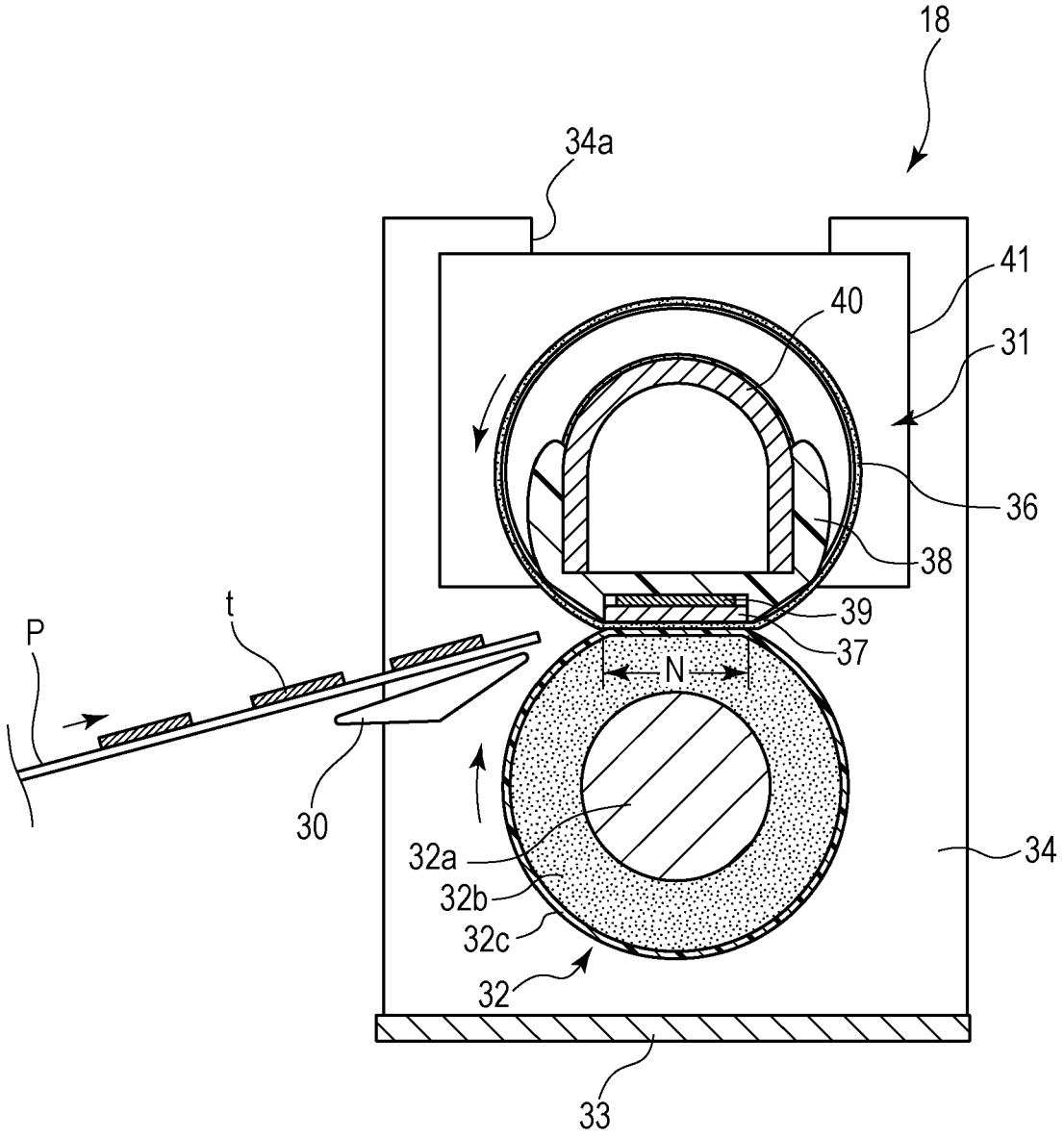
FIG. 1 is a schematic sectional view of a fixing device according to a first embodiment of the present invention.
Figure 2:
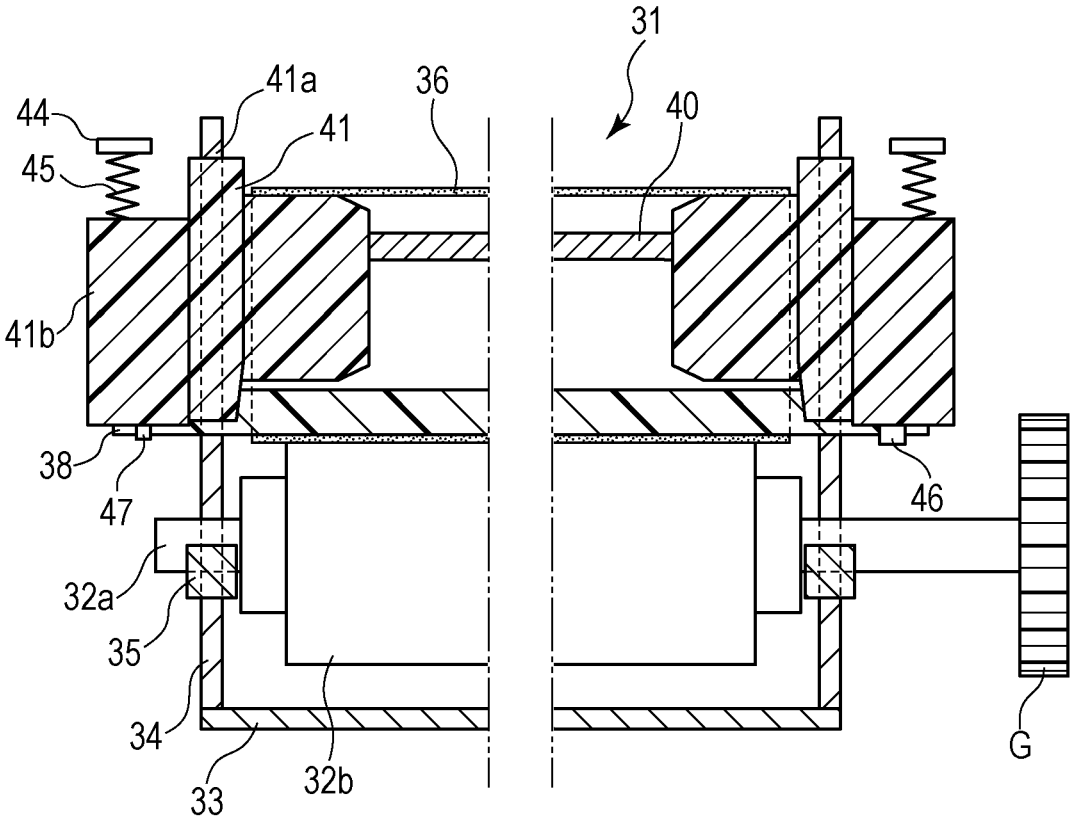
FIG. 2 is a schematic front view of the fixing device according to the first embodiment.

FIG. 1 is a schematic sectional view of a fixing device 18 according to a first embodiment of the present invention that is taken in the short-side direction. FIG. 2 illustrates two long-side-direction ends of the fixing device 18.

The fixing device 18 includes a film unit 31 including a flexible tubular film 36. The fixing device 18 further includes a pressing roller 32 as a backup member. The film unit 31 and the pressing roller 32 are provided between right and left side plates 34 of a device frame 33 and extend substantially parallel to each other. A heater 37 is provided on the inner side of the film 36 at a position facing the pressing roller 32.

The pressing roller 32 includes a metal core 32*a*, an elastic layer 32*b* provided over the outer periphery of the metal core 32*a*, and a release layer 32*c* provided over the outer periphery of the elastic layer 32*b*. The elastic layer 32*b* is made of silicone rubber, fluororubber, or the like. The release layer 32*c* is made of perfluoroalkoxy polymer (PFA), polytetrafluoroethylene (PTFE), fluorinated ethylene propylene (FEP), or the like.

In the first embodiment, the pressing roller 32 is formed as follows. A metal core 32*a* is formed of stainless steel in such a manner as to have an outside diameter of 11 mm. An elastic layer 32*b* is formed of silicone rubber over the metal core 32*a* by injection molding in such a manner as to have a thickness of about 3.5 mm. A release layer 32*c* in the form of a PFA resin tube having a thickness of about 40 μm is provided over the elastic layer 32*b*. Thus, a pressing roller 32 having an outside diameter of 18 mm is obtained. To assuredly form a nip N and in terms of durability and so forth, the pressing roller 32 can have an Asker C hardness of 40 degrees to 70 degrees under a load of 9.8 N. In the first embodiment, the Asker C hardness of the pressing roller 32 is set to 54 degrees. The length of the elastic layer 32*b* of the pressing roller 32 in the long-side direction is 226 mm. As illustrated in FIG. 2, the pressing roller 32 is positioned between and is rotatably supported by the side plates 34 of the device frame 33 with bearing members 35 provided at two respective long-side-direction ends of the metal core 32*a*. A driving gear G is fixedly provided at one end of the metal core 32*a* of the pressing roller 32. A driving force is transmitted from a drive source (not illustrated) to the driving gear G, whereby the pressing roller 32 rotates.

The film unit 31 illustrated in FIG. 1 includes the film 36, the heater 37 provided in contact with the inner surface of the film 36, a metal plate 39 provided in contact with a surface of the heater 37 that is opposite the surface that is in contact with the inner surface of the film 36, and a supporting member 38 that supports the heater 37 with the metal plate 39 interposed therebetween. The film unit 31 further includes a pressing stay 40 that reinforces the supporting member 38, and flanges 41 regulates a movement of the film 36 in the long-side direction.

The film 36 is a flexible member that includes a base layer, an elastic layer provided over the outer periphery of the base layer, and a release layer provided over the outer periphery of the elastic layer. The film 36 according to the first embodiment is a tube having an inside diameter of 18 mm. The base layer is made of polyimide and has a thickness of 60 μm. The elastic layer is made of silicone rubber and has a thickness of about 150 μm. The release layer is made of PFA and has a thickness of 15 μm. As illustrated in FIG. 1, the supporting member 38 has a substantially semicircular bucket-like cross-sectional shape. The supporting member 38 is a rigid, heat-resistant, and heat-insulating member. The supporting member 38 according to the first embodiment is made of liquid crystal polymer. The supporting member 38 has a function of supporting the film 36, which is provided around the supporting member 38, from the inner side of the film 36, and a function of supporting the heater 37 from one side of the heater 37.

Figure 3:
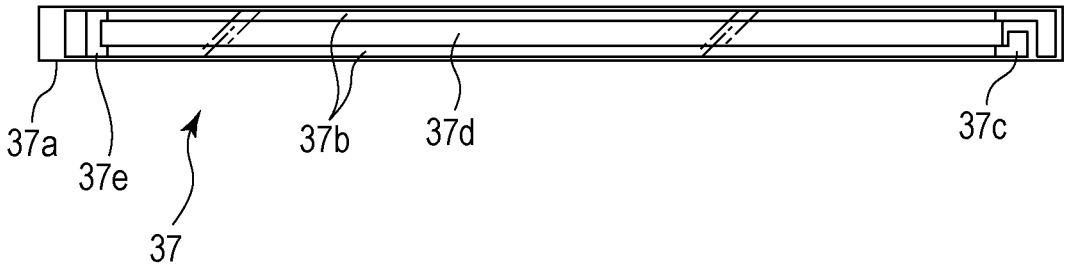
FIG. 3 illustrates a heater according to the first embodiment.

As illustrated in FIG. 3, the heater 37 includes a substrate 37*a* made of ceramic such as alumina or aluminum nitride, a pattern of heat-generating resistor 37*b* made of a silver-palladium alloy or the like and formed on the substrate 37*a* by screen printing or the like, and an electrical contact portion 37*c* made of silver or the like and connected to the pattern of heat-generating resistor 37*b*. In the first embodiment, two heat-generating resistors 37*b* having a resistance of 18Ω are connected in series. Furthermore, a glass coat 37*d* as a protective layer is provided over the heat-generating resistors 37*b*, whereby the heat-generating resistors 37*b* are protected, and the slidability of the heater 37 with respect to the film 36 is increased. The heater 37 faces a supporting surface of the supporting member 38 and extends in a direction of the generating line of the film 36. The substrate 37*a* of the heater 37 according to the first embodiment has a rectangular parallelepiped shape with a long-side-direction length of 270 mm, a short-side-direction length of 5.8 mm, and a thickness of 1.0 mm and is made of alumina. The heat-generating resistors 37*b* form a U-shaped pattern by being connected to each other with an electrical contact portion 37*e* at one long-side-direction end of the heater 37. The heat-generating resistor 37*b* on the upstream side and the heat-generating resistor 37*b* on the downstream side are of the same shape and each have a long-side-direction length of 222 mm and a short-side-direction length of 0.9 mm. The heat-generating resistors 37*b* on the upstream side and on the downstream side are each positioned at a distance of 0.7 mm from a corresponding one of two short-side-direction ends of the substrate 37*a*, which is made of ceramic, and are printed at respective positions that are symmetrical to each other with respect to the short-side-direction center of the substrate 37*a*. Heat-resistant grease is applied to the inner surface of the film 36. Thus, the slidability between the inner surface of the film 36 and the heater 37 and the supporting member 38 is increased.

Figure 4:
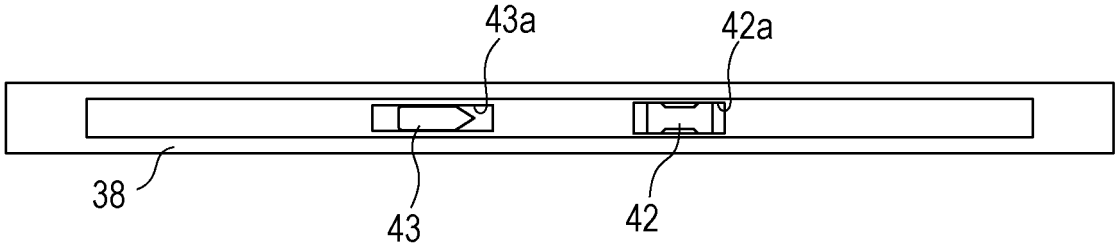
FIG. 4 illustrates the positions of a thermistor and a thermal fuse included in the heater according to the first embodiment.

FIG. 4 illustrates the supporting member 38, a thermistor 42, and a thermal fuse 43. The thermistor 42 is a temperature-sensitive element. The supporting member 38 has through holes 42*a* and 43*a*. The thermistor 42 as a temperature-detecting element and the thermal fuse 43 as a safety element are provided in the through holes 42*a* and 43*a*, respectively, in such a manner as to be in contact with the metal plate 39, which is a heat-conductive member. That is, a temperature-sensitive element is provided on a heat-conductive member in such a manner as to sense the heat of the heater 37 through the heat-conductive member.

The thermistor 42 includes a housing, in which a thermistor element is provided with ceramic paper or the like interposed therebetween. The ceramic paper or the like is provided for stabilizing the state of contact between the thermistor element and the heater 37. Furthermore, the thermistor element is covered with an insulating material such as polyimide tape. If the temperature of the heater 37 has risen excessively, the thermal fuse 43 detects the excessive rise of the temperature of the heater 37. In response to this, the thermal fuse 43 cuts off the supply of power to the heater 37. The thermal fuse 43 includes a round-tubular metal housing, in which a fuse element that melts at a predetermined temperature is provided. If the temperature of the heater 37 has risen excessively and the fuse element is melted and cut, a circuit for supplying power to the heater 37 is cut off. The thermal fuse 43 is in contact with the metal plate 39 with heat-conductive grease interposed therebetween. Thus, any malfunctions that may occur if the thermal fuse 43 goes out of contact with the heater 37 are suppressed.

Referring to FIG. 1, the pressing stay 40 has an inverted-U cross-sectional shape and extends in the direction of the generating line of the film 36. The pressing stay 40 is provided for enhancing the flexural rigidity of the film unit 31. The pressing stay 40 according to the first embodiment is made of a 1.6 mm-thick stainless-steel sheet that is bent in the U shape.

The right and left flanges 41 hold two respective ends of the pressing stay 40. The flanges 41 have respective longitudinal grooves 41*a*, with which longitudinal grooves 34*a* provided in the respective right and left side plates 34 of the device frame 33 are in engagement. In the first embodiment, the flanges 41 are made of liquid-crystal polymer.

Referring to FIG. 2, the right and left flanges 41 each include a pressed portion 41*b*. A pressing spring 45 is provided between the pressed portion 41*b* and a pressing arm 44. Hence, the heater 37 is pressed, together with the right and left flanges 41, the pressing stay 40, and the supporting member 38, toward the pressing roller 32 with the film 36 interposed between the heater 37 and the pressing roller 32. In the first embodiment, the total contact pressure generated between the film 36 and the pressing roller 32 is 180 N. Since the heater 37 is pressed against the pressing roller 32, which has elasticity, with the film 36 interposed therebetween, a nip N having a width of about 6 mm is formed between the heater 37 and the pressing roller 32.

When the fixing device 18 is activated, a rotational force is transmitted from the drive source (not illustrated) to the driving gear G provided to the pressing roller 32, whereby the pressing roller 32 rotates clockwise in FIG. 1 at a predetermined speed. In the first embodiment, the speed of rotation of the pressing roller 32 is set such that a recording material P is conveyed at 100 mm/sec. With the rotation of the pressing roller 32, a frictional force is generated at the nip N between the pressing roller 32 and the film 36, and the frictional force acts on the film 36 as a rotational force. Thus, as illustrated in FIG. 1, the film 36 that is in contact with one surface of the heater 37 slides on that surface of the heater 37 while rotating counterclockwise around the supporting member 38 by following the rotation of the pressing roller 32.

The recording material P is introduced into the nip N when the film 36 is rotated, the heater 37 is supplied with power, and the temperature of the heater 37 that is detected by the thermistor 42 has reached a target fixing temperature. A fixing-device entrance guide 30 guides the recording material P carrying an unfixed toner image t toward the nip N.

When the recording material P carrying the unfixed toner image t is introduced into the nip N, a surface of the recording material P that is on the side having the unfixed toner image t comes into close contact with the film 36. In this state, the recording material P is conveyed together with the film 36. In this conveying process, the unfixed toner image t on the recording material P is fixed on the recording material P with the heat of the film 36 that has been heated by the heater 37. The recording material P that has passed through the nip N is self-stripped from the surface of the film 36, is discharged from the nip N, and is discharged to the outside of the fixing device 18 by a pair of discharge rollers (not illustrated). In the fixing device 18 according to the first embodiment, the maximum width of the recording material conveyable is 216 mm, and 20 letter-size recording materials per minute are fixable.

Features of First Embodiment

Figure 5A:
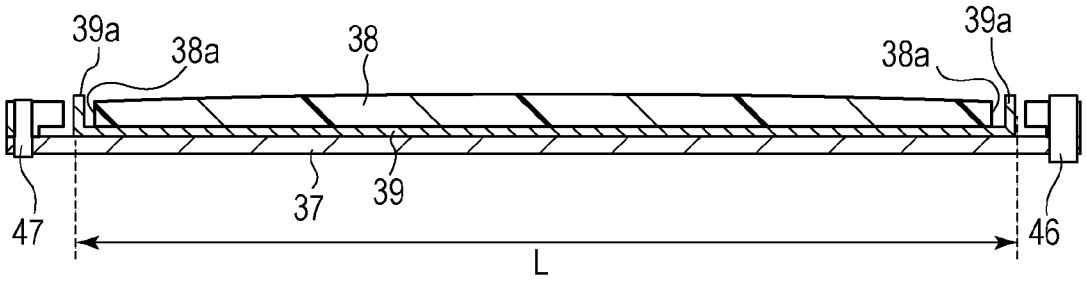
FIG. 5A illustrates how the heater and a metal plate are supported by a supporting member according to the first embodiment.
Figure 5B:
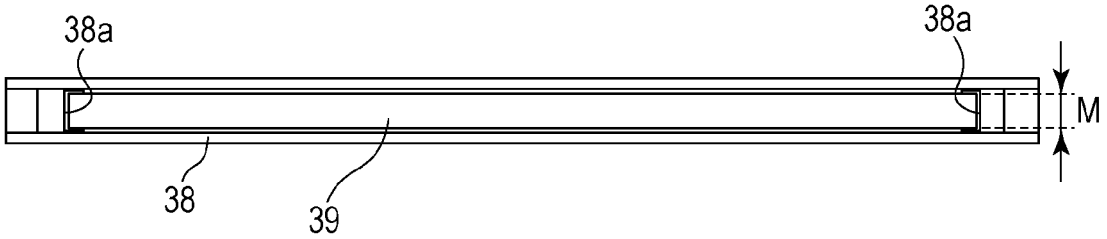
FIG. 5B illustrates how the metal plate is supported by the supporting member according to the first embodiment.
Figure 5C:
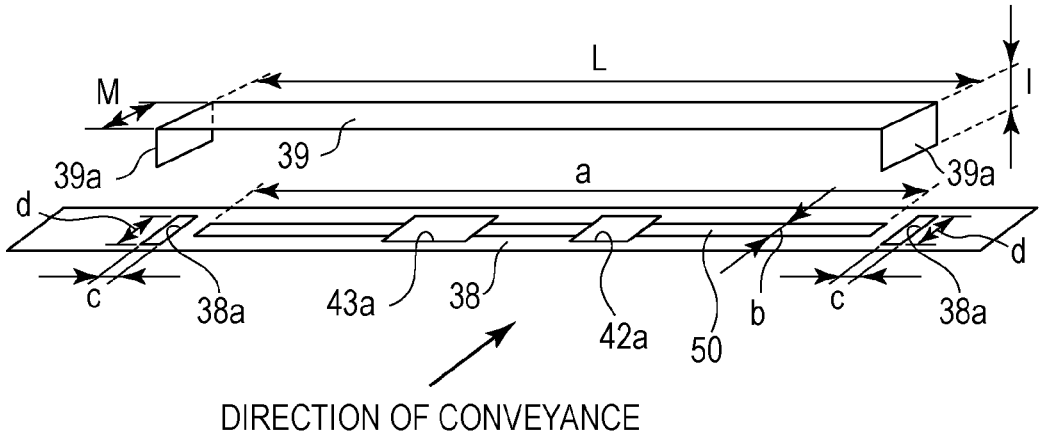
FIG. 5C is a perspective view of the metal plate and the supporting member according to the first embodiment and illustrates the positions of engaging portions of the metal plate and a spot-faced portion of the supporting member.

Referring to FIGS. 5A to 5C, a structure of supporting the metal plate 39, as a heat-conductive member, in the film unit 31 according to the first embodiment will first be described. FIG. 5A is a sectional view of the structure that is taken in the long-side direction. FIG. 5B illustrates a state where the metal plate 39 is attached to the supporting member 38, with the heater 37 removed. FIG. 5C is a perspective view of the metal plate 39 and the supporting member 38 and illustrates engaging portions of the metal plate 39 and a spot-faced portion of the supporting member 38. In FIGS. 5A to 5C, the thermistor 42 and the thermal fuse 43 are not illustrated.

As illustrated in FIGS. 5A and 5B, in the first embodiment, the metal plate 39 is placed on the supporting member 38, and the heater 37 is placed on the metal plate 39. In a toner-image-heating area (an area within which the recording material P passes), the supporting member 38 is not in contact with the surface of the heater 37 that faces the metal plate 39. The supporting member 38 is in contact with the heater 37 at the two long-side-direction ends of the heater 37. At the two long-side-direction ends of the heater 37, the heater 37 is held to the supporting member 38 by a power feeding connector 46 and a heater clip 47 (a holding member). That is, the heater 37 is supported by the supporting member 38 with the metal plate 39 interposed therebetween in the toner-image-heating area but is directly in contact with and supported by the supporting member 38 at the two ends on the outer sides of the toner-image-heating area.

Figure 6A:
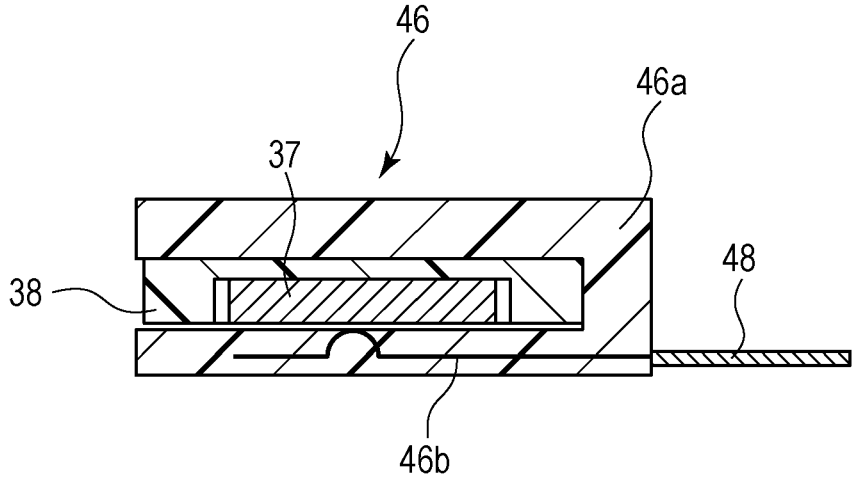
FIG. 6A illustrates a power feeding connector according to the first embodiment.

As illustrated in FIG. 6A, the power feeding connector 46 includes a housing portion 46*a* and a contact terminal 46*b*. The housing portion 46*a* has a rectangular U shape and is made of resin. The power feeding connector 46 encloses and thus holds the heater 37 and the supporting member 38. Furthermore, the contact terminal 46*b* is in contact with the electrical contact portion 37*c* (an electrode) of the heater 37. Thus, the power feeding connector 46 is electrically connected to the heater 37. The contact terminal 46*b* is connected to a bundle wire 48. The bundle wire 48 is connected to an alternating-current (AC) power supply (not illustrated), specifically, a triac.

Figure 6B:
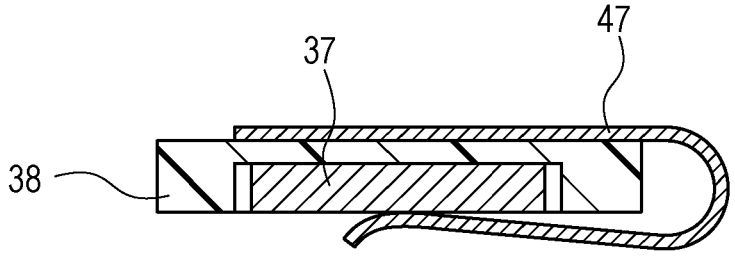
FIG. 6B illustrates a heater clip according to the first embodiment.

As illustrated in FIG. 6B, the heater clip 47 is a metal plate that is bent in a U shape. The heater clip 47 as a holding member holds the heater 37 by bringing the end of the heater 37 into contact with the supporting member 38 by utilizing the spring characteristic thereof. The end of the heater 37 that is held by the heater clip 47 is movable in a direction parallel to the surface of the heater 37. Hence, if the heater 37 is thermally expanded, the heater 37 is prevented from being subjected to an unwanted stress.

Referring to FIG. 5C, the metal plate 39, the engaging portions provided in the supporting member 38 for engagement with the metal plate 39, and the spot-faced portion provided in the supporting member 38 will now be described. In the first embodiment, the metal plate 39 is an aluminum plate having a constant thickness of 0.3 mm. The portion of the metal plate 39 that is in contact with the heater 37 has a length L of 222 mm and a width M of 4 mm. The width M is measured in the direction of conveyance of the recording material P. The metal plate 39 includes bent portions 39*a* at both longitudinal ends thereof. The bent portions 39*a* each have a length 1 of 3 mm. The bent portions 39*a* are fitted in respective fitting holes 38*a*, which are the engaging portions, provided in the supporting member 38. The fitting holes 38*a* each have a size that is slightly larger than the size of a corresponding one of the bent portions 39*a* so that the thermal expansion of the metal plate 39 can be absorbed by the fitting holes 38*a*. In the first embodiment, the size of each fitting hole 38*a* is c=0.4 mm by d=4.1 mm. The supporting member 38 has a spot-faced portion 50 (a recess) having a long-side-direction length a of 216 mm, a short-side-direction length b of 2 mm, and a depth of 0.2 mm.

The substrate 37*a* according to the first embodiment is a rectangular parallelepiped member having a long-side-direction length of 270 mm, a short-side-direction length of 5.8 mm, and a thickness of 1.0 mm. The substrate 37*a* is made of alumina. The heat-generating resistors 37*b* each have a long-side-direction length of 222 mm.

Figure 7A:
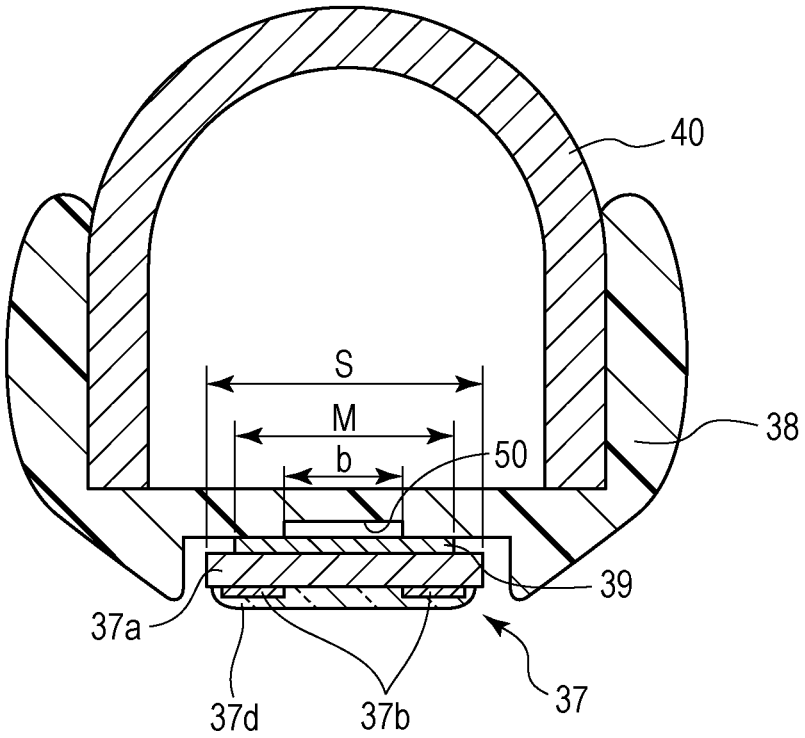
FIG. 7A is a schematic sectional view of a part of the fixing device according to the first embodiment and illustrates the positions of the heater, the metal plate, and the spot-faced portion.
Figure 7B:
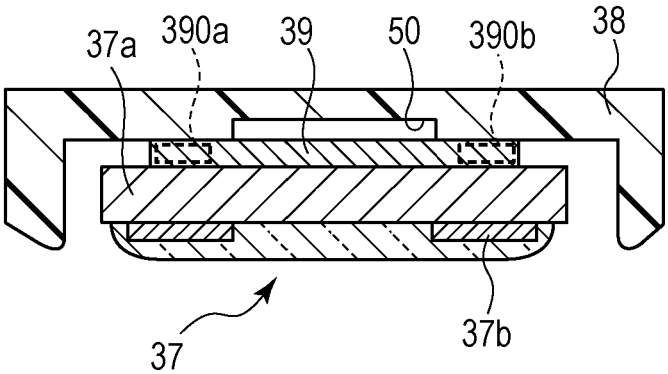
FIG. 7B is an enlarged view of a part near the heater illustrated in FIG. 7A.
Figure 7C:
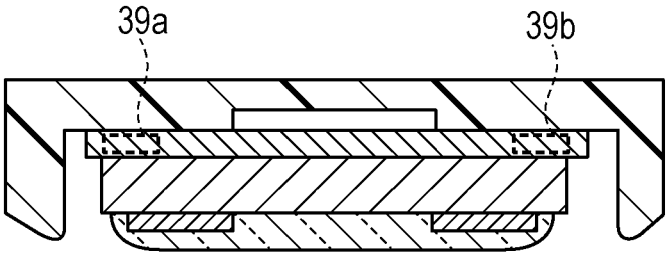
FIG. 7C is an enlarged view of a part near a heater according to a modification of the first embodiment.

Referring to FIGS. 7A to 7C, features of the first embodiment will now be described. FIG. 7A is a schematic sectional view of a part of the fixing device 18 and illustrates the positions of the heater 37, the metal plate 39, and the spot-faced portion 50. FIG. 7B is an enlarged view of a part near the heater 37 illustrated in FIG. 7A.

Referring to FIG. 7B, in a portion of the metal plate 39 that is in contact with the heater 37, a part at one end in the direction of conveyance of the recording material P is denoted as a first part 390*a*, and a part at the other end in the direction of conveyance of the recording material P is denoted as a second part 390*b*. Referring to FIG. 7B, the first part 390*a* corresponds to an end of the metal plate 39 that is on the upstream side in the direction of conveyance of the recording material P, and the second part 390*b* corresponds to an end of the metal plate 39 that is on the downstream side in the direction of conveyance of the recording material P. The first part 390*a* and the second part 390*b* of the metal plate 39 are in contact with and held between the supporting member 38 and the heater 37. The supporting member 38 has the spot-faced portion 50 (a non-contact area) in which the supporting member 38 is not in contact with the metal plate 39. The spot-faced portion 50 is positioned between the first part 390*a* and the second part 390*b* in the direction of conveyance of the recording material P.

Referring to FIG. 7A, the substrate 37*a* has a width S of 5.8 mm. The metal plate 39 has a width M of 4 mm. The spot-faced portion 50 of the supporting member 38 has a width b of 2 mm. That is, the width of the substrate 37*a* is larger than the width of the metal plate 39, and the width of the metal plate 39 is larger than the width of the spot-faced portion 50 of the supporting member 38.

The term "direction of conveyance of the recording material P" is the same as "direction orthogonal to the direction of the generating line of the film 36."

Advantageous Effects of First Embodiment

Figure 8A:
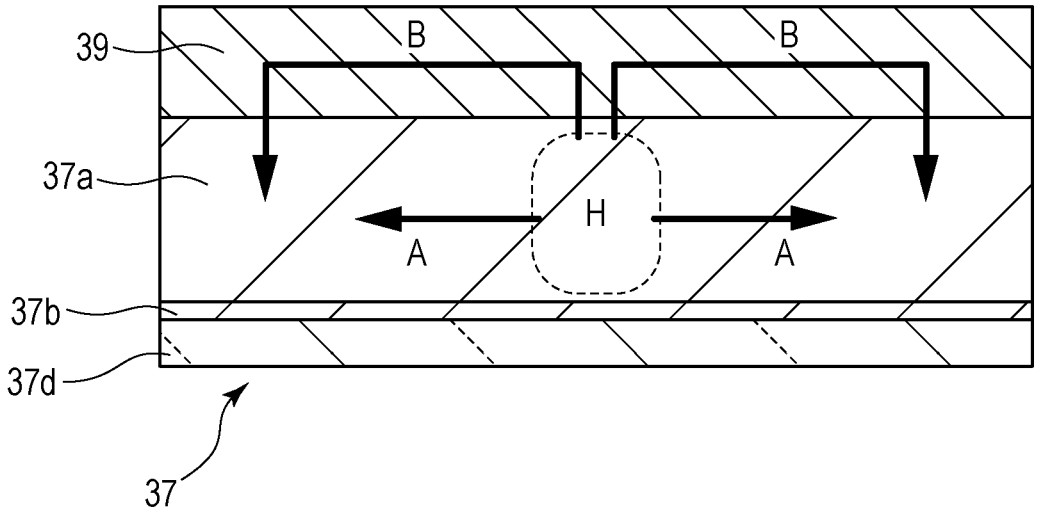
FIG. 8A is an enlarged view of a part of the heater and a part of the metal plate and illustrates flows of heat from the heater.

The substrate 37*a* according to the first embodiment is made of alumina having a thermal conductivity of about 26 W/mK. The metal plate 39 according to the first embodiment is made of aluminum having a thermal conductivity of about 230 W/mK, which is higher than the thermal conductivity of the substrate 37*a*. Referring now to FIG. 8A, suppose that the temperature in a region H of the substrate 37*a* that is at a certain position in the long-side direction has become higher than the other regions of the substrate 37*a*. In addition to flows of heat A occurring in the long-side direction in the substrate 37*a*, flows of heat from the substrate 37*a* toward the metal plate 39 occur in a region of the substrate 37*a* that is in contact with the metal plate 39. Such heat flows in the long-side direction in the metal plate 39 and returns to the substrate 37*a*, that is, flows of heat B occur. With such flows of heat, the temperature distribution of the heater 37 is evened out.

Figure 8B:
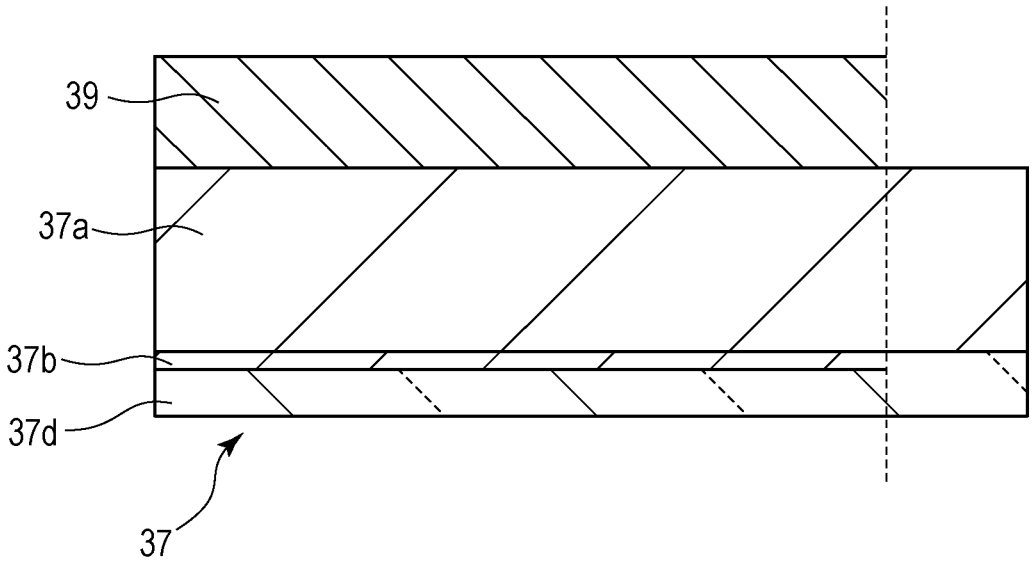
FIG. 8B is an enlarged view of a part of the heater and a part of the metal plate that are at a long-side-direction end.

FIG. 8B illustrates the positional relationship between a long-side-direction end of one of the heat-generating resistors 37*b* of the heater 37 and a long-side-direction end of the metal plate 39. In the first embodiment, as illustrated in FIG. 8B, each heat-generating resistor 37*b* of the heater 37 and the metal plate 39 have the same length. A length of the metal plate 39 in the conveyance direction is shorter than a length of the heater 37 in the conveyance direction.

Figure 9:
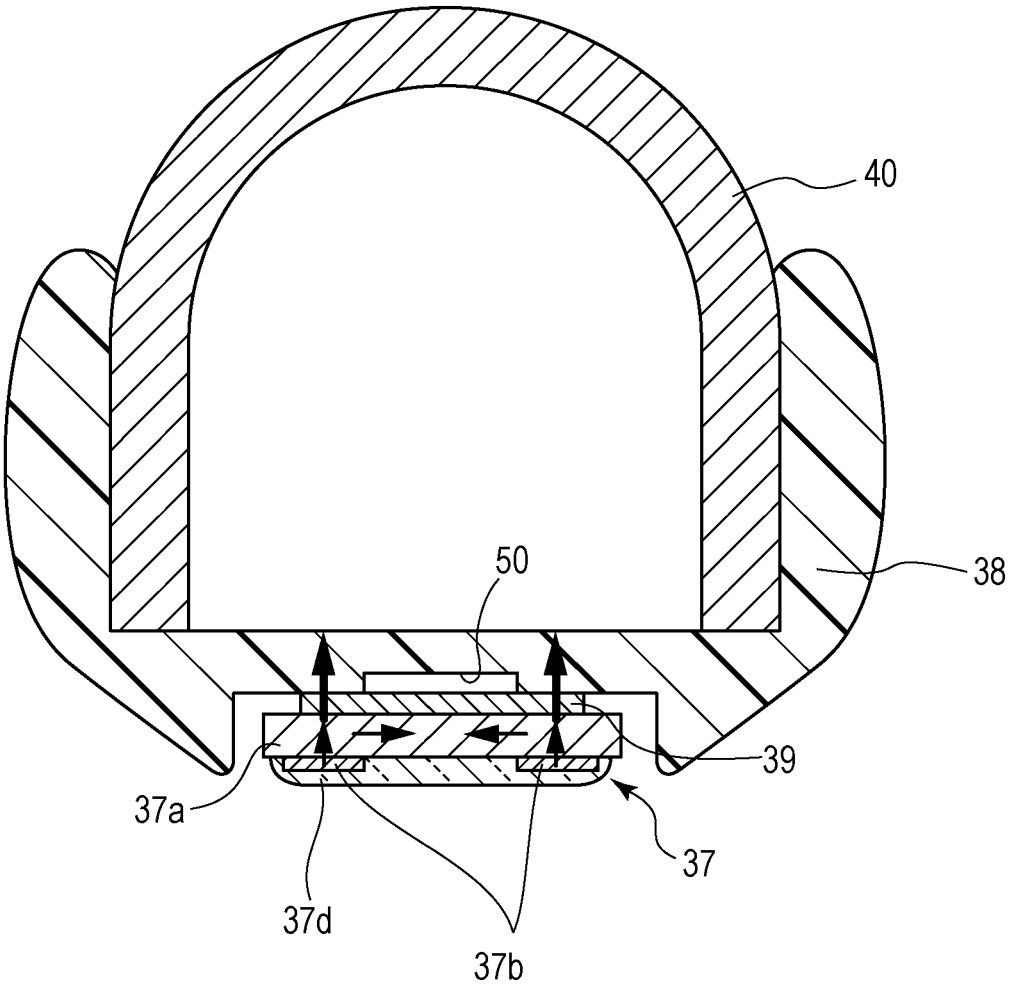
FIG. 9 is a schematic sectional view of a part of the fixing device according to the first embodiment and illustrates flows of heat occurring from the heater toward the supporting member.
Figure 10A:
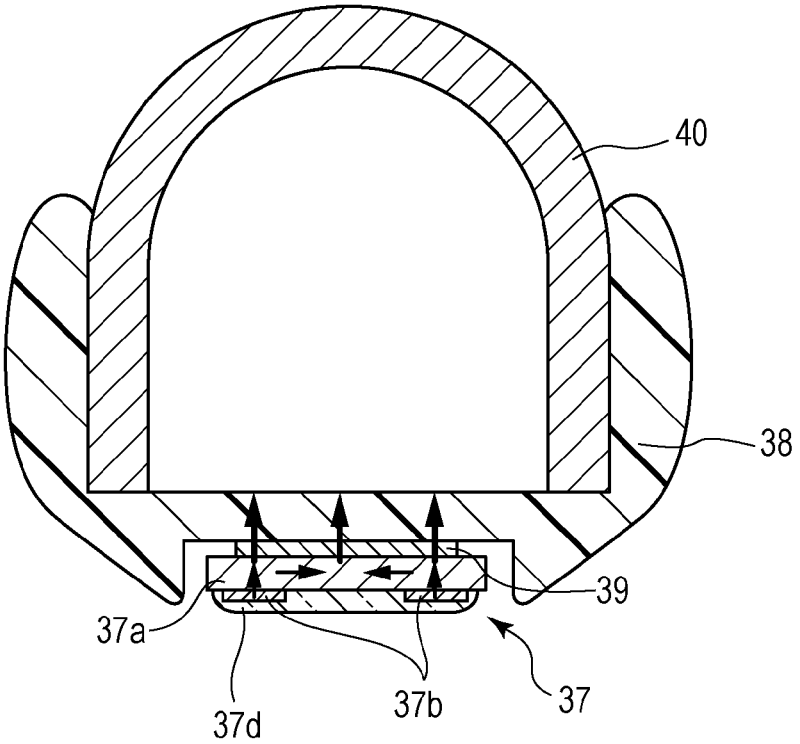
FIG. 10A illustrates flows of heat observed in Comparative Example 1.
Figure 10B:
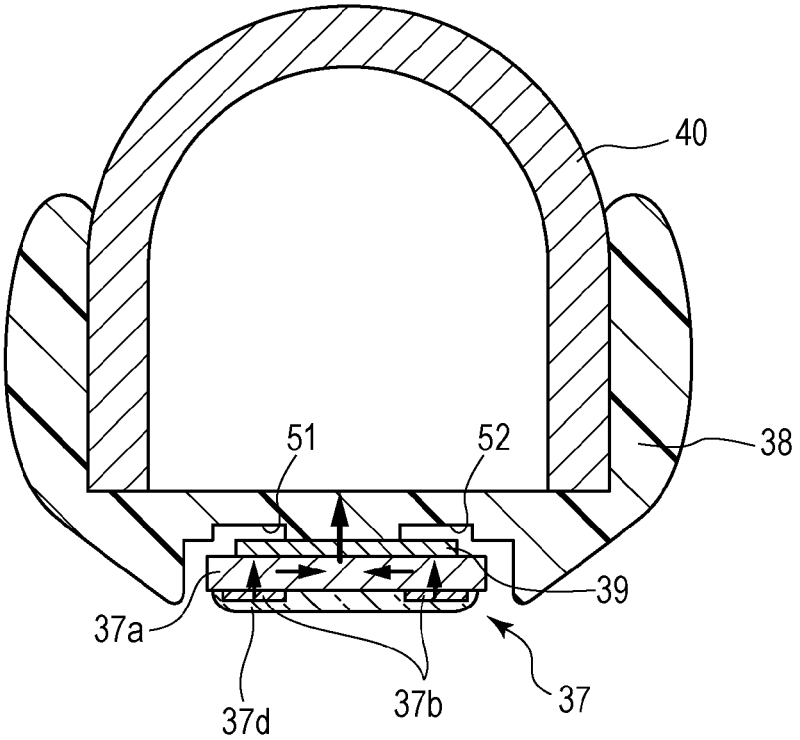
FIG. 10B illustrates flows of heat observed in Comparative Example 2.

FIG. 9 illustrates flows of heat occurring among the heater 37, the metal plate 39, and the supporting member 38 when power is supplied to the heat-generating resistors 37*b* of the heater 37 according to the first embodiment. FIGS. 10A and 10B illustrate flows of heat occurring in fixing devices according to comparative examples, respectively. FIG. 10A illustrates Comparative Example 1 in which the supporting member 38 does not have the spot-faced portion 50 that is employed in the first embodiment. FIG. 10B illustrates Comparative Example 2 in which the supporting member 38 has spot-faced portions 51 and 52 that face two respective ends, in the direction of conveyance of the recording material P, of the metal plate 39. In Comparative Example 1, the metal plate 39 absorbs heat of the heater 37 by the entire width-direction region thereof and transfers the heat to the supporting member 38. Therefore, flows of heat occur as represented by arrows illustrated in FIG. 10A. Since these flows of heat make it difficult to quickly heat the heater 37, the warm-up time of the fixing device becomes long. In Comparative Example 2, heat of the heater 37 does not flow toward the supporting member 38 through the metal plate 39 in areas where the spot-faced portions 51 and 52 are provided. Therefore, the heater 37 is heated quickly and the warm-up time of the fixing device becomes short. Here, note that the two ends of the metal plate 39 in the direction of conveyance of the recording material P are each not held between the supporting member 38 and the heater 37. Hence, at the two ends of the metal plate 39 in the direction of conveyance of the recording material P, the closeness between the metal plate 39 and the heater 37 is not assuredly maintained, and the ends of the metal plate 39 may be separated from the heater 37. In that case, the effect of evening out the temperature distribution of the heater 37 may be reduced.

In contrast, according to the first embodiment illustrated in FIG. 9 (FIG. 7B), the first part 390*a* and the second part 390*b* at the two ends of the metal plate 39 are each held between the supporting member 38 and the heater 37. Therefore, the closeness between the metal plate 39 and the heater 37 is assuredly maintained. That is, the two ends of the metal plate 39 in the direction of conveyance of the recording material P are prevented from being separated from the heater 37. Furthermore, the supporting member 38 has the spot-faced portion 50 that is positioned between the first part 390*a* and the second part 390*b*. Therefore, in the area where the spot-faced portion 50 is provided, heat of the heater 37 is not transferred to the supporting member 38 through the metal plate 39. Hence, the warm-up time of the fixing device 18 becomes short.

An experiment of demonstrating the above effect produced in the first embodiment was conducted. Table 1 summarizes the results of measuring the time period (warm-up time) from when power started to be supplied to the heater 37 until when the temperature detected by the thermistor 42 reached the target fixing temperature, in the first embodiment, in Comparative Example 1, and in Comparative Example 2. It was found that the warm-up time in the first embodiment was shorter than the warm-up time in Comparative Example 1 but was almost the same as the warm-up time in Comparative Example 2.

TABLE 1

| | 1st embodiment | Comparative Example 1 | Comparative Example 2 |
|---|---|---|---|
| Warm-up time (sec) | 9.2 | 9.8 | 9.1 |

Another feature of the first embodiment is that, as illustrated in FIG. 7B, the heat-generating resistors 37*b* of the heater 37 extend in such a manner as to overlap the first part 390*a* and the second part 390*b*, respectively, of the metal plate 39 in the direction of conveyance of the recording material P. In such a configuration, if the supply of power to the heater 37 becomes unstoppable (if the heater 37 goes out of control), the heat of the heat-generating resistors 37*b* is transferred to the supporting member 38 along the shortest path through the metal plate 39. Consequently, the thermal fuse 43 is activated well before the heater 37 cracks. Since there is enough time from when the thermal fuse 43 is activated until when the heater 37 cracks, the interval to the execution of the fixing process performed on a subsequent recording material P in a case where recording materials P of small sizes are processed successively can be made short. Hence, the productivity in the printing of small-size recording materials P is improved.

To demonstrate the above effect, envelops of the COM10 size (104.7 mm by 241.3 mm) were successively subjected to the fixing process in each of the first embodiment, Comparative Example 1, and Comparative Example 2, and the number of envelopes that were processed before the heater 37 cracked was counted. Note that, practically, the heater 37 never cracks because the thermal fuse 43 is broken and the supply of power to the heater 37 is cut off before the heater 37 cracks.

TABLE 2

| | 1st embodiment | Comparative Example 1 | Comparative Example 2 |
|---|---|---|---|
| Number of envelopes processed before heater cracked | 22 | 22 | 19 |

According to Table 2, the number of envelopes processed before the heater 37 cracked in the first embodiment was greater than that of Comparative Example 2 but was the same as that of Comparative Example 1. The above effect is produced when at least a part of the heat-generating resistors 37*b* overlaps the metal plate 39 in the direction of conveyance of the recording material P.

To summarize, the first embodiment provides a fixing device in which the excessive rise of the temperature in the non-sheet-passing area is suppressed while a short warm-up time is realized.

According to the first embodiment, the width of the metal plate 39 is smaller than the width of the heater 37. The first embodiment may be modified as illustrated in FIG. 7C, that is, the width of the metal plate 39 may be larger than the width of the heater 37. In the modified configuration illustrated in FIG. 7C, however, the heat capacity of the metal plate 39 is larger than that of the metal plate 39 in the configuration illustrated in FIG. 7B. Hence, the modified configuration is disadvantageous in terms of the warm-up time of the fixing device.

The advantageous effects produced in the first embodiment can be produced even if the metal plate 39 is replaced with a graphite plate. Instead of the plate-like member, a flexible sheet-like member may be used.

The fixing device 18 according to the first embodiment is configured such that a combination of the heater 37 and the pressing roller 32 forms the nip N with the film 36 interposed therebetween, and the recording material P is conveyed through the nip N. The present invention is not limited to such a configuration. While the heater 37 is in contact with the inner surface of the film 36, the nip N may be formed by a combination of a nip forming member, which is separate from the heater 37, and the pressing roller 32 with the film 36 interposed therebetween. Alternatively, the film unit 31 according to the first embodiment may be an external heating unit provided in contact with a fixing roller that forms a nip in combination with the pressing roller 32.

In the first embodiment, the supporting member 38 has the spot-faced portion 50. Alternatively, the metal plate 39 may have a spot-faced portion, so that a non-contact area where the supporting member 38 and the metal plate 39 are not in contact with each other is provided.

Second Embodiment

A second embodiment of the present invention will now be described, focusing on features of the second embodiment. Description of elements that are the same as those of the fixing device 18 according to the first embodiment is omitted. In the second embodiment, the width of the nip N is larger than that of the first embodiment, whereby the fixability of the fixing device is improved. Specific changes are as follows.

The short-side-direction length of the heater 37 is 9 mm. The short-side-direction length of a portion of the supporting member 38 that supports the heater 37 is made larger by about 3 mm than in the first embodiment. The hardness of the pressing roller 32 is set to 49 degrees, and the operating length of the pressing spring 45 is set so that the total contact pressure generated between the film 36 and the pressing roller 32 becomes 200 N. Thus, the width of the nip N is set to about 9 mm.

Figure 11:
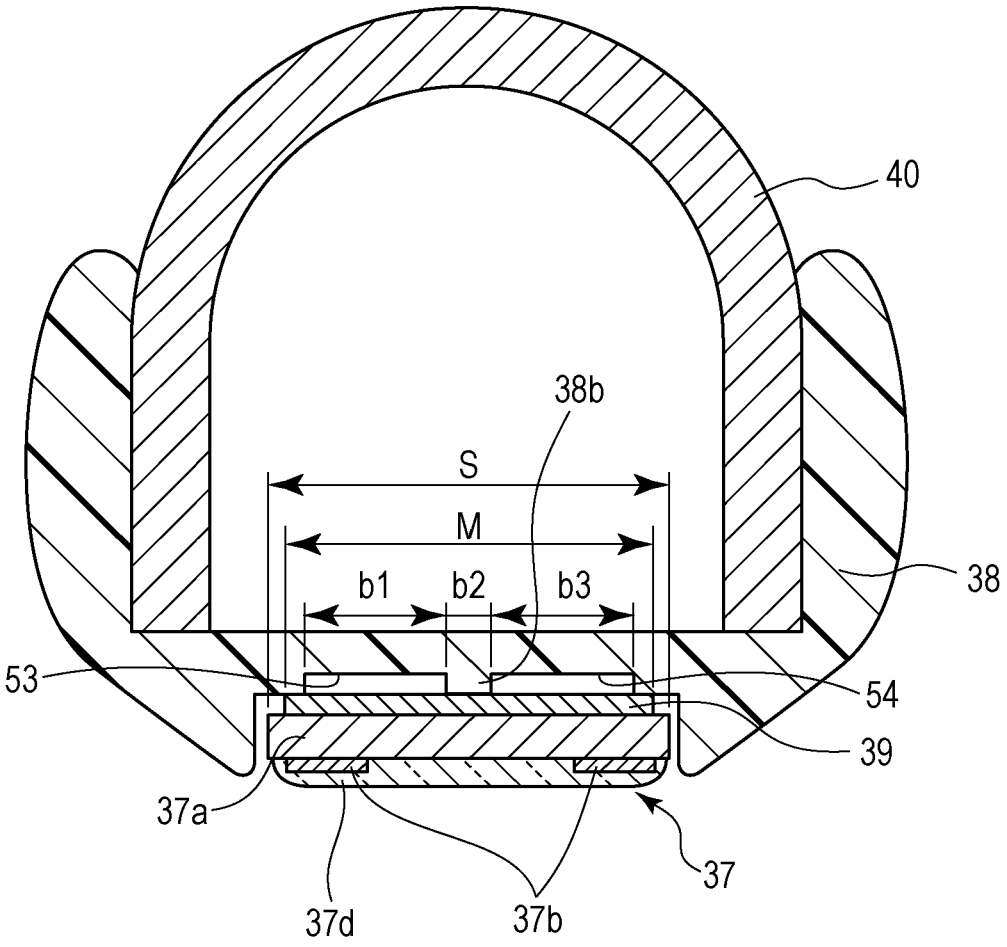
FIG. 11 is a schematic sectional view of a part of a fixing device according to a second embodiment and illustrates the positions of a heater, a metal plate, and spot-faced portions.

FIG. 11 is a sectional view of a part of the fixing device according to the second embodiment. The heater 37 is supported by the supporting member 38 with the metal plate 39 interposed therebetween. The substrate 37*a* has a width S of 9 mm. The metal plate 39 has a width M of 7 mm. Spot-faced portions 53 and 54 of the supporting member 38 each have a width b1 or b3 of 2.1 mm. The width of the substrate 37*a* is larger than the width of the metal plate 39. The width of the metal plate 39 is larger than the width of each of the spot-faced portions 53 and 54 of the supporting member 38. The second embodiment differs from the first embodiment in that the supporting member 38 includes, at the center thereof, a portion (third part) 38*b* having a width b2 of 1.6 mm and being in contact with the metal plate 39. That is, the metal plate 39 according to the second embodiment is held between the supporting member 38 and the heater 37 at the two ends and at the center thereof in the direction of conveyance of the recording material P.

In such a configuration according to the second embodiment, even if the nip N has a large width, the central portion of the metal plate 39 in the direction of conveyance of the recording material P is not separated from the heater 37. Therefore, the closeness between the heater 37 and the metal plate 39 is assuredly maintained.

To summarize, the second embodiment provides a fixing device whose nip has a large width and in which the excessive rise of the temperature in the non-sheet-passing area is suppressed while a short warm-up time is realized.

Third Embodiment

Figure 12:
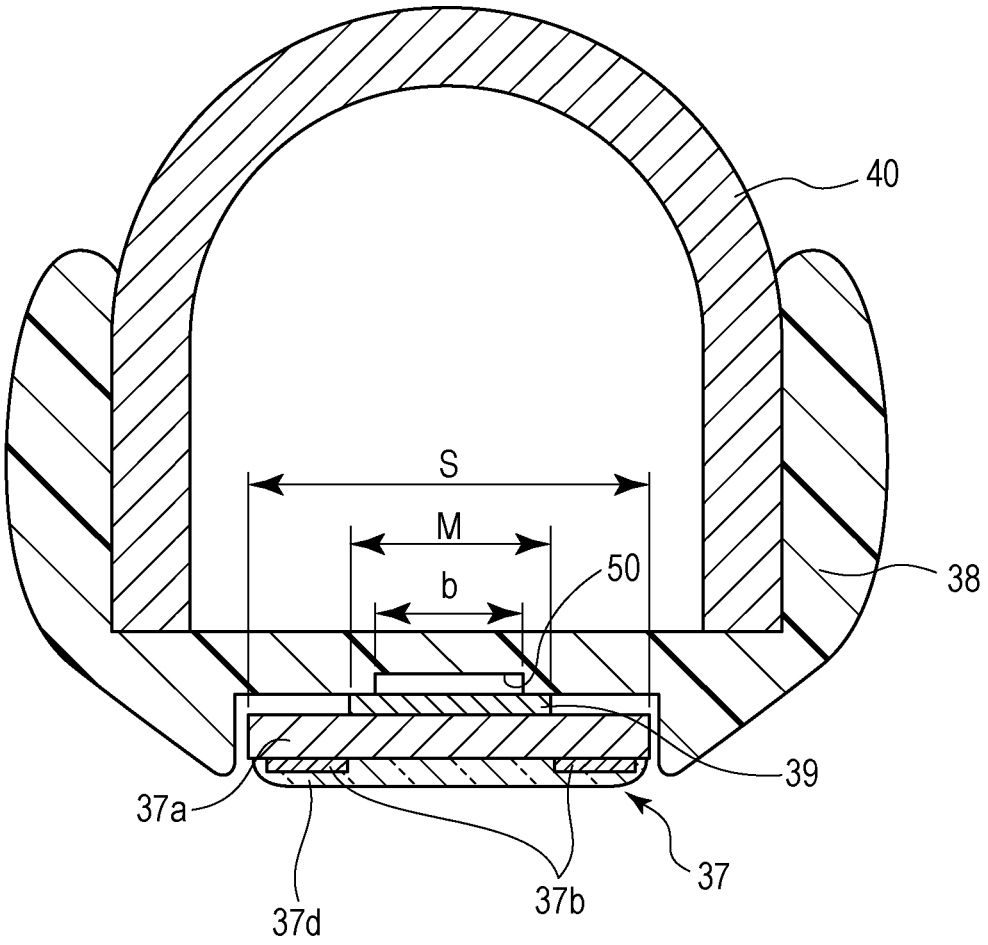
FIG. 12 is a schematic sectional view of a part of a fixing device according to a third embodiment and illustrates the positions of a heater, a metal plate, and a spot-faced portion.

A third embodiment of the present invention will now be described, focusing on features of the third embodiment. Description of elements that are the same as those of the fixing device 18 according to the first embodiment is omitted. As illustrated in FIG. 12, which is a schematic sectional view of a part of the fixing device according to the third embodiment, the metal plate 39 is positioned between the two heat-generating resistors 37*b* of the heater 37 in such a manner as not to overlap the heat-generating resistors 37*b* in the direction of conveyance of the recording material P. In the fixing device according to the third embodiment that is configured as described above, the heat of the heater 37 is less likely to be transferred to the supporting member 38 than in the first embodiment. Hence, the third embodiment is more advantageous than the first embodiment in terms of the reduction in the warm-up time of the fixing device. The metal plate 39 according to the third embodiment overlaps neither of the two heat-generating resistors 37*b* of the heater 37 in the direction of conveyance of the recording material P. However, the above effects can be produced as long as the width of a portion of each heat-generating resistor 37*b* that does not overlap the metal plate 39 is larger than the width of a portion of the heat-generating resistor 37*b* that overlaps the metal plate 39.

To summarize, the third embodiment provides a fixing device in which the excessive rise of the temperature in the non-sheet-passing area is suppressed while a much shorter warm-up time is realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-226484, filed Nov. 6, 2014, which is hereby incorporated by reference herein in its entirety.

What is claimed is:

1. A fixing device that fixes a toner image on a recording material while conveying the recording material carrying the toner image at a nip, the fixing device comprising:

a tubular film;

a heater including a first surface that is in contact with the film, the heater including a substrate and a heat-generating resistor provided on the substrate;

a heat-conductive member having a higher thermal conductivity than the substrate, configured to contact a second surface of the heater opposite to the first surface of the heater; and a supporting member configured to support the heater via the heat-conductive member interposed between the supporting member and the heater, wherein the heat-conductive member includes bent portions which are bent toward the supporting member at both longitudinal end portions of the heat-conductive member, and wherein the supporting member includes:

openings where the respective bent portions of the heat-conductive member are inserted;

first and second parts formed on an opposed surface of the supporting member opposed to the heat-conductive member, the first and second parts being arranged in a short direction of the heater and sandwiching the heat-conductive member with the heater; and a recess part formed on the opposed surface of the supporting member and recessed from the heat-conductive member, the recess part being arranged between the openings in a longitudinal direction of heater and between the first and second parts in the short direction of the heater.

2. The fixing device according to claim 1, wherein the heat-conductive member is a metal plate.

3. The fixing device according to claim 1, further comprising a backup member that forms a nip in combination with the heater via the film interposed between the backup member and the heater, the recording material being conveyed through the nip.

4. The fixing device according to claim 1, wherein the first and second parts of the supporting member sandwiches, with the heater, both end of the heat-conductive member in the short direction of the heater.

5. The fixing device according to claim 1, wherein a width of the recess part is narrower than a width of the openings in the short direction of the heater.

6. The fixing device according to claim 1, wherein the supporting member includes a contact part on the opposed surface of the supporting member between the recess part and the openings in the longitudinal direction of the heater, the contact part contacting the heat-conductive member.

* * * * *